United States Patent [19]

Walsh, III

[11] 4,311,174

[45] Jan. 19, 1982

[54] SAFETY DISPENSER ATTACHMENT FOR DANGEROUS LIQUID ADDITIVES

[75] Inventor: John M. Walsh, III, Madison, N.J.

[73] Assignee: Bull & Roberts, Inc., Murray Hill, N.J.

[21] Appl. No.: 146,669

[22] Filed: May 5, 1980

[51] Int. Cl.[3] ..... B65B 3/04

[52] U.S. Cl. ..... 141/383; 141/311 R; 251/89.5

[58] Field of Search ..... 137/614.06; 141/311 R, 141/346, 347, 352, 363, 383–386, 392; 222/162, 325, 521; 251/89.5, 149.9

[56] References Cited

U.S. PATENT DOCUMENTS 4,207,934 6/1980 Scremin et al. ..... 141/383

*Primary Examiner*—Frederick R. Schmidt
*Attorney, Agent, or Firm*—Arthur B. Colvin

[57] ABSTRACT

A dispenser safety attachment for liquid additives and particularly for periodically dispensing increments of liquid additive which are corrosive, carcinogenic or otherwise possess qualities which suggest that contact therewith be avoided. The device is characterized by the provision of a receptacle adapted to be secured to a tank or like receiver or conduit for materials to be treated and a container adapted to be mounted in the receptacle, the container including a valve mechanism, known per se, and subject to opening and closing by relative rotation of the container and a spout. The receptacle and container interact in such manner that increments of the liquid in the container may be dispensed by relatively rotating the container and receptacle which has been mounted on the tank by torsional forces applied to the container. The container and receptacle interact to prevent facile removal of the container except when the valve mechanism has been rotated to its closed position whereby the possibility of leakage of the dangerous contents is minimized upon removal of the container from the receptacle.

7 Claims, 9 Drawing Figures

FIG. 1
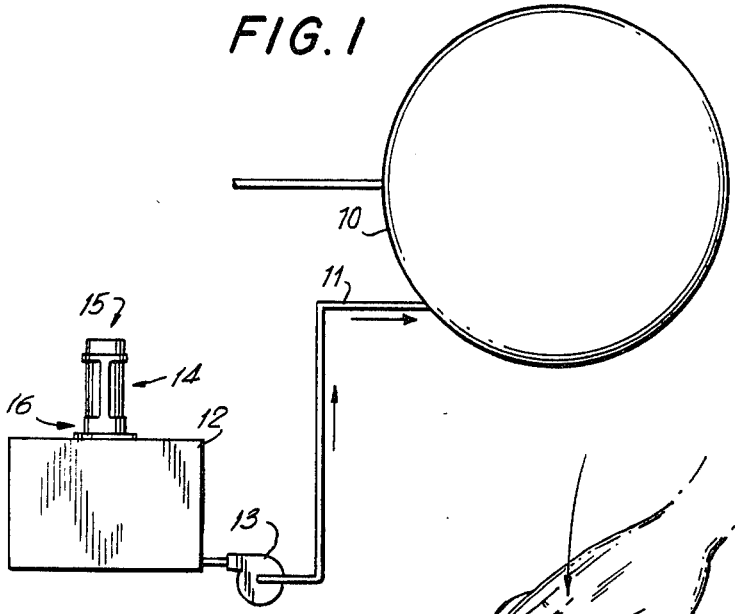
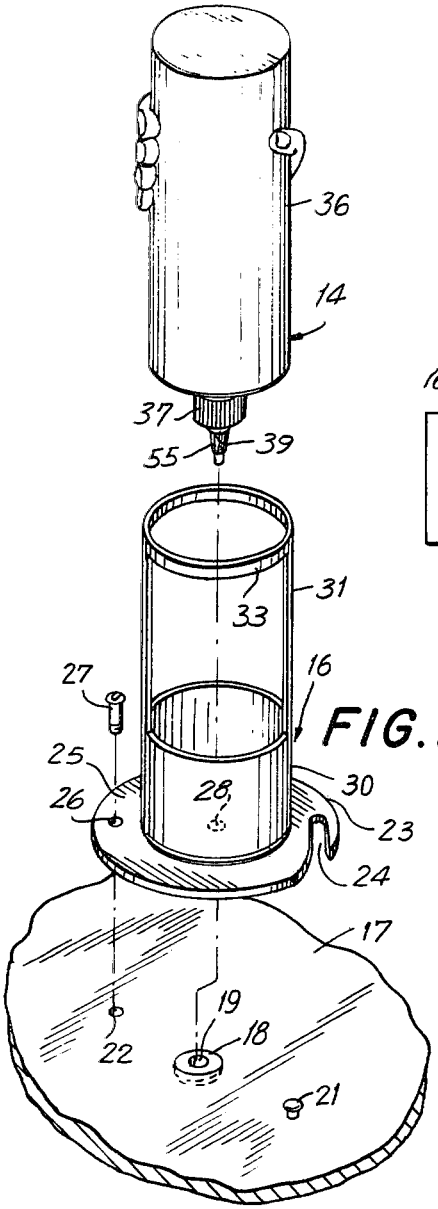
FIG. 2
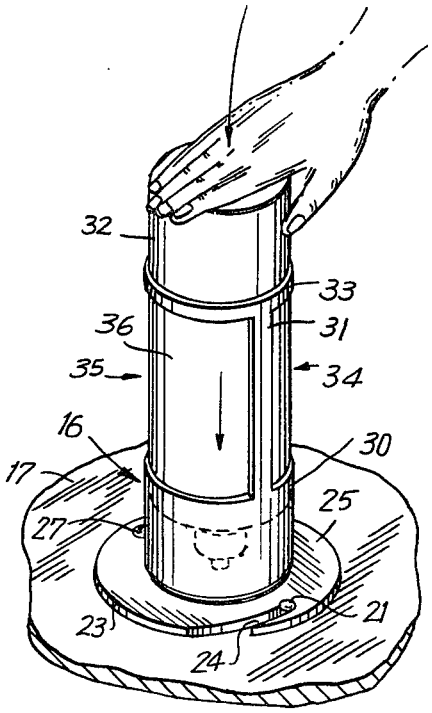
FIG. 3
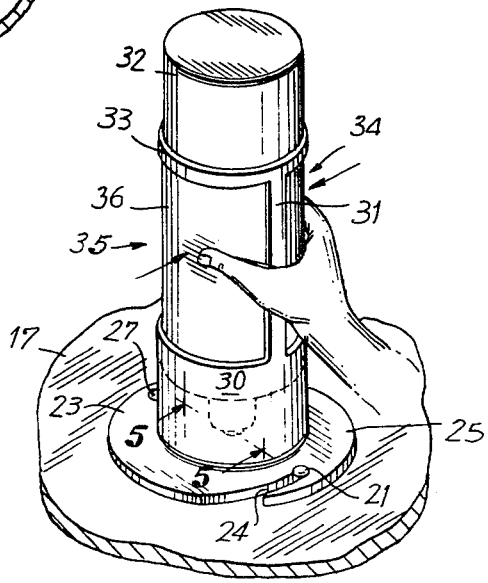
FIG. 4

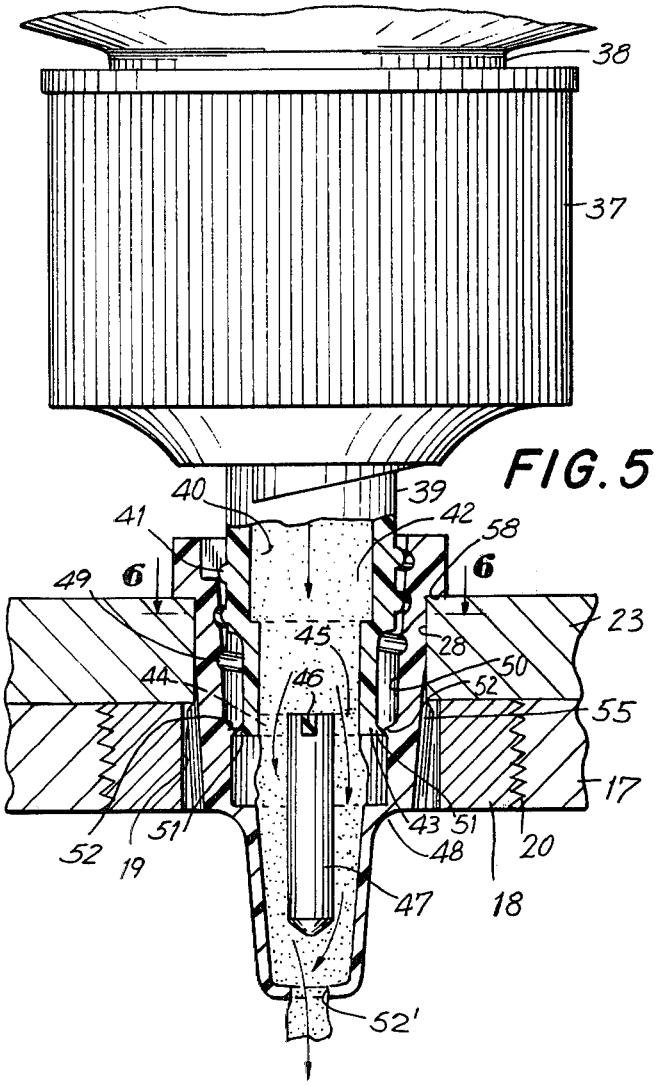
FIG. 5
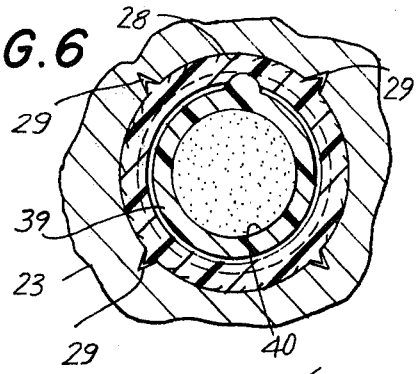
FIG. 6
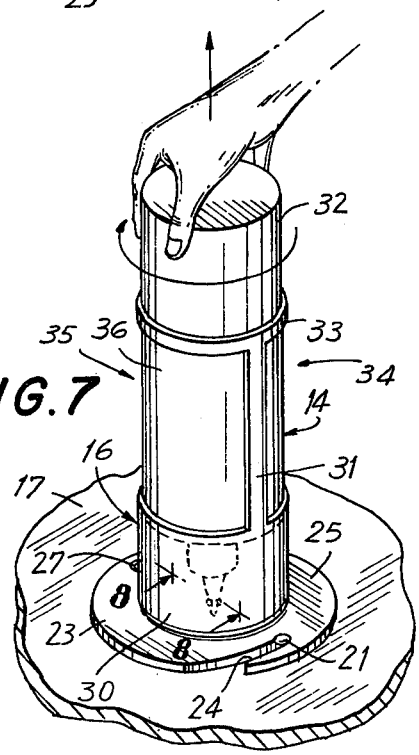
FIG. 7
FIG. 8
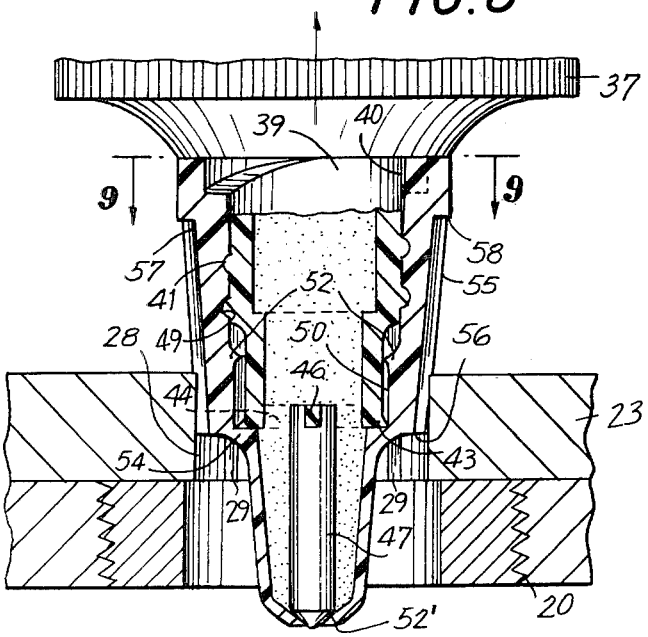
FIG. 9
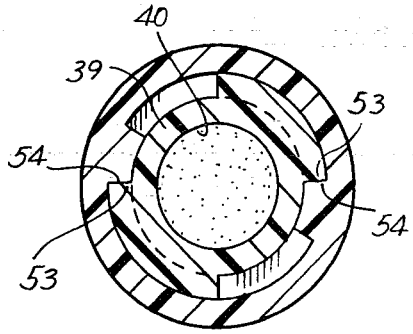

SAFETY DISPENSER ATTACHMENT FOR DANGEROUS LIQUID ADDITIVES

BACKGROUND OF THE INVENTION

1. Field of the Invention

The present invention is in the field of liquid treatment apparatus and pertains more particularly to an assemblage adapted to be mounted on a treatment tank or conduit into which quantities of treatment liquid must be periodically introducted, the liquid being supplied in replaceable containers.

2. The Prior Art

As conducive to an understanding of the present invention, it will be noted that there are many reagents which must be periodically added in measured quantities to liquid systems as for the treatment of the systems or like applications. By way of example and without limitation, it is current practice, in order to minimize scale and like build-up in boilers, to introduce into the boiler on a periodic basis increments of liquid material, such as solutions of hydrazine or caustic soda.

Caustic soda is, of course, extremely corrosive and will damage skin permitted to contact the same. Hydrazine, in addition to being inflammable and corrosive, is also a suspected carcinogen.

In the past, reagents have been added by pouring a lpredetermined quantity thereof into a measuring cup or the like from a large container and then pouring the measured quantity into the system to be treated.

During the course of pouring the reagent into the measuring cup and then from the measuring cup into the system, the reagent is exposed to the atmosphere and hence the vaporized reagent can be inhaled by the workman and furthermore spills are likely to occur onto the skin of the workman.

It has been suggested to utilize as the carrier of the reagent a plastic container, known per se, which container includes a spout member having an internal valve arrangement which enables the valve to be closed by relative rotation of the container and spout in a first direction and opened by counter rotation of the components. Fluid is introduced into the system to be treated by removing a closure to the system, opening the valve of the container, inserting the spout through the enclosure and compressing the container, to express a desired quantity of the fluid. Thereafter, the spout must be gripped manually and retro-rotated to shift the valve to the closed position and the closure reapplied to the system.

Obviously, the various steps outlined may result in increments of the fluid being deposited outside the system in the course of opening and closing of the spout and injection of the material into the system.

More importantly, droplets of the dangerous liquid may gather on the spout and the operator must then take exceptional precautions in cleaning the spout before handling the same to close it.

Frequently, the operator will disregard or not understand the dangerous nature of the liquid and manually close the spout, permitting his fingers to contact the dispensed liquid.

SUMMARY

The present invention may be summarized as directed to a novel safety dispenser device especially adapted for use with dangerous corrosive, carcinogenic or inflammable liquids to be introduced into a treatment system.

The device enables liquid transfer from a spouted container to the system without handling the spout, while still permitting opening and closing of a valve controlled by the spout.

The invention is further directed to a dispenser device of the type described wherein a container may be positioned in dispensing relation to a system to be treated and increments may be released therefrom to the system without the necessity for handling any portion of the container proximate to the liquid release orifice, whereby contact of the hands of the operator with the fluid is positively avoided.

The invention refers further to a device of the type described wherein an essentially conventional container coacts with a safety dispenser attachment in such manner that it is relatively difficult to remove the container from the dispenser, as for replacement, unless the valve mechanism of the container is in the closed position.

More specifically, the device comprises a receptacle adapted to be secured to a conduit or tank to be treated, the receptacle being provided with a throughgoing aperture having a wall defining serrated gripper portions.

The dispenser container, which is known per se, includes a resiliently deformable spout rotatable relative to the container, a valving mechanism being interposed between the spout and container whereby, when the spout is rotated in a first direction, the valve is opened and fluids may be dispensed as by compressing the walls of the container. Counter-rotation of the container seats the valve.

The container embodies a threaded arrangement with the spout whereby relative rotation of the spout and container in an opening direction permits the spout and container to free wheel, i.e., continuously to rotate without separation of the parts. When the spout and container are relatively rotated in a closing direction, the spout and container lock at the limiting closed position, and further relative rotation cannot be accomplished.

The gripper assembly of the receptacle engages the spout in such manner that after the spout is thrust into the aperture it cannot be removed in an axial direction under normal axial withdrawing pressures. However, the container may be removed by a combined axial removal force on the container and relative rotation of the spout and gripper mechanism. Since such relative rotation can be effected only in the closed position of the valve, it will be seen that a combined axial and rotary removing force can be applied only after the container has been closed. Thus, it is relatively difficult to remove the container in a condition in which the valve is open, thereby insuring against leakage of the remnants of the corrosive or otherwise dangerous contents.

Accordingly, it is an object of the invention to provide a safety dispenser device for liquids.

A further object of the invention is the provision of a device of the type described which enables the container to be shifted between an open dispensing condition and a closed sealing condition without manual handling of any portion of the container adjacent the dispensing orifice.

Still a further object of the invention is the provision of a device of the type described whereby the container and receptacle interact in such manner that removal of the container from the receptacle can be conveniently accomplished only after the valve of the substantially empty container has been closed, whereby inadvertant leakage is positively prevented.

To attain these object and such further objects as may appear herein or be hereinafter pointed out, reference is made to the accompanying drawings, in which:

FIG. 1 is a diagrammatic view of the liquid circulating system in which the container and receptacle have been installed;

FIG. 2 is an exploded perspective view of the components of the system;

FIG. 3 is a perspective view showing the position of the parts on insertion of a container into the receptacle;

FIG. 4 is a view similar to FIG. 3 showing the device in a dispensing mode;

FIG. 5 is a magnified section taken on the line 5—5 of FIG. 4 showing details of the valve mechanism when the same is in a dispensing mode;

FIG. 6 is a vertical section taken on the line 6—6 of FIG. 5;

FIG. 7 is a view similar to FIG. 3 illustrating the steps necessary for removal of an exhausted container;

FIG. 8 is a section taken on the line 8—8 of FIG. 7 showing the dispensing aperture in closed position before the container has been pushed fully inwardly;

FIG. 9 is a section taken on the line 9—9 of FIG. 8.

Referring now to the drawings, there is schematically shown in FIG. 1 a liquid circulating system which illustratively includes a device 10, such as a boiler, which requires for its efficient operation the periodic addition of quantities of caustic or otherwise dangerous liquids. The device 10 may include an input line 11 fed from storage tank 12 via pump 13.

Periodically caustic liquid such as a 15% solution of Hydrazene or a caustic soda solution must be added to the water in the tank 12. For this purpose a dispenser device 14, which comprises a container member 15 and a receptacle 16 is secured to the tank 12 in a manner shown in greater detail in the other figures.

The receptacle 16 is mounted on tank wall 17. For such purpose an insert member 18 having a throughgoing central aperture 19 is mounted in the wall 17 of the tank as by forming a bore in the tank and tapping the bore to accommodate the external threads 20 of the insert 18. A headed stud 21 may be secured to the wall 17 of the tank. A tapped receiver aperture 22 is likewise formed in the wall 17.

The receptacle 16 includes a base plate or member 23 having an arcuate receiver slot 24 adapted to be inserted in spanning relation of the shank of stud 21 such that the headed component of the stud 21 overlies the upper surface 25 of the base plate 23.

The tapped aperture 22 is spaced to register with a further bore 26 in the base plate, enabling the receptacle to be permanently affixed to the wall 17 of the tank, as by a machine screw 27 extending through the bore 26 and threaded into the aperture 22.

The receptacle is shown in FIGS. 3 and 4 in its mounted condition.

The base plate 23 includes a further throughgoing aperture 28 which, in the mounted position of the receptacle, registers with the aperture 19 in insert 18.

As more particularly shown in FIG. 6, for example, the aperture or bore 28 includes a plurality of radially directed serrations 29 opening onto the bore 28. In the illustrated embodiment it will be seen that serrations 29 comprise recessed, vertically directed V-shaped grooves. However, it will be readily recognized that the serrations may comprise inwardly directed teeth or, if desired, may contain inclined projections forming, in substance, short increments of a thread pattern, the angle being calculated to facilitate removal of the container 15.

The receptacle 16 includes a skirt portion 30 adjoining the base and surrounding the bore or aperture, from the upper edge of which skirt 30 projects outwardly a protective cage member 31.

As best seen from FIGS. 3 and 4, the container 15 is of an axial extent to project outwardly beyond the edge of the cage 31 in its installed position, whereby the end portion 32 of the container which projects beyond the outermost rim 33 of the skirt may be readily gripped for the application of torque to the container.

The cage assembly 31 includes cut out side portions 34, 35 which enable the operator manually to grip and inwardly compress the side wall portions 36 of the container for forcing fluids from the container into the tank 12.

As heretofore noted, the container and its dispensing spout are known per se and will accordingly be described hereinafter only to the extent necessary for an appreciation of the functional interrelationship thereof with the receptacle.

More particularly, the container 14 includes a cap member 37 internally threaded and connected to a complementally threaded neck portion 38 at the outer end of the container. The cap portion 37 includes an integral, axially directed extension 39 including an axially extending passage 40 leading to the interior of the cap 37 and hence communicated with the contents of the container.

The extension 39 includes an external thread portion 41. The terminal end 43 of the extension 39 includes a disk 44 provided with throughgoing apertures 45, the portions between the angularly spaced apertures defining spokes 46 extending radially inwardly from the end 43 of the extension. The spokes 46 support an integral valve element 47 which projects axially beyond the end 43 of the extension 39.

A spout member 48 is mounted on the thread portion 41 of the extension, the spout member and normally the remaining components of the container being formed of a resilient, deformable polymeric substance such as polyethylene. The spout member is provided with an internal thread 49 in complemental engagement over the thread 41 whereby, by relatively rotating the spout 48 and the container 36, the spout will be shifted axially outwardly to the dispensing position shown in FIG. 5 or axially inwardly to the shut or sealed position shown in FIG. 8.

It is a conventional feature of the spout mechanism, important to the operation of the herein described device, that the spout and the extension 39 be free wheeling in the fully open position shown in FIG. 5 when the same are relatively rotated in a continuing opening direction. That is to say, after the spout and container have been relatively rotated to the full open position of the valve, the thread dimensions are such that the spout and container, while not subject to separation in an axial direction, may nonetheless be relatively rotated without further axial separating movements between the parts. This desired effect is accomplished by providing a slight taper to the bore 50 of the spout whereby the thread portions of the spout and extension relatively release at the full open position, and by providing a flared out portion 51 at the distal end of the extension, which flare is slightly larger in diameter than the adjacent portions 52 of the bore.

In the closing direction as seen in FIG. 8, the interengaging thread portions 41 of the extension and 49 of the spout act to shift the container downwardly into the bore 50 of the spout in such manner that the valve member 47 within the extension 39 is pressed tightly into the dispensing aperture 52′ formed in the end of the spout, FIG. 8. In this orientation it will be seen that the container is sealed.

In the closed position of FIG. 8, further relative rotation of the spout 48 on the extension 39 is positively precluded by the sealing of the valve member and by the interaction of abutment portions 53 formed on the extension 39 against radially directed shoulders 54 formed on the interior surface of bore 50 of the spout.

As best seen in FIGS. 2, 5 and 8, the external surface 55 of the spout is tapered, being wider toward the container and narrower toward the dispensing aperture 52, the surface 55 preferably, in addition, being corrugated to define vertically directed knurling.

The bore 28 formed in the base plate 23 is dimensioned so as to be of a diameter larger than the diameter of the frusto-conical external surface 55 at the lead edge 56 thereof, but smaller than the diameter of said surface at the largest base 57 thereof. The spout may include a stop shoulder 58 adjacent the base 57.

The operation of the device will be apparent from the preceding description.

A receptacle 16 is mounted over a tank to be treated in the manner previously set forth. A container 14 is inserted into operative position within the receptacle by forcing the same sharply axially downwardly, (FIG. 3) with the spout of the device aligned with the aperture 28 formed in the base plate.

The container is forced downwardly inwardly, compressing the knurled outer surface 55 of the spout (compare FIG. 8—expanded—and FIG. 5—compressed) until the stop shoulder 58 is engaged against the upper surface of the plate 23 surrounding the opening 28. In this position, by virtue of the compression of the spout within the opening 28, the resilience of the spout material, and the action of the serrations 29, the spout is tightly supported within the aperture and cannot be readily dislodged by the application of an axial force against the container.

When it is desired to administer treatment to the tank 12, the projection portions 32 of the container are gripped and rotated in an anti-clockwise direction when viewed in the orientation of FIG. 3 until the valve mechanism is open. Thereafter the desired increments of liquid are dispensed by compressing the walls of the container through the access provided by spaces 34, 35 in the skirt.

Obviously the container may include graduations enabling the amount of fluid dispensed to be measured.

The fluid flow is limited by compression of the walls of the container since the container and spout form a sealed system and fluids will not flow therefrom under gravitational influence.

As noted, since the device is free wheeling in the fully open position, undue rotation of the container in an opening (anti-clockwise) direction cannot result in the separation of the container from the control spout. When the desired amount of fluid has been added to the system, the container is rotated in a clockwise direction (FIG. 7) until it is apparent from the increased force necessary to turn the same that the valve is in its closed position.

It is an important feature of the present invention that the container can readily be removed from the receptacle only when the valve is in the closed position of FIG. 8. Attempts axially to extract the container will be frustrated by the tight interfit between the spout and the aperture or bore 28. However, if a combined rotary and axial movement is exerted on the container, the rotary force applied being sufficient to effect relative movement in a rotary direction between the spout and the bore, the spout will easily be dislodged from its locked position in the aperture due to distortion of the plastic knurling of the spout. This will permit the container to be withdrawn and replaced.

However, since a rotary force sufficient to effect movement between the spout and the base plate can be exerted against the spout only when the spout is in its closed position, per FIG. 8, it will be seen that the container may be removed only when the valve assembly is in the sealing position depicted in said FIG. 8.

From the foregoing, it will be evident that there is shown and described a dispenser assemblage whereby containers prefilled with corrosive or otherwise dangerous fluids may be inserted into a fluid treatment system and the container opened and closed remotely, i.e., without any contact adjacent the fluid dispensing aperture.

Additionally, the container can be readily removed from its engaged position only when the valve mechanism is shut since removal requires a combined axial and rotary force to be exerted on the spout and such rotational force can be transmitted to the spout only in the closed position of the valve.

It will be obvious to those skilled in the art and familiarized with the instant disclosure that structural variations may be made in the illustrated device without departing from the spirit of the invention, which is accordingly to be broadly construed within the scope of the appended claims.

Having thus described my invention, what I claim as new and desire to secure by Letters Patent of the United States is:

1. A safety dispenser attachment for the dispensing of corrosive or like liquid additives adapted to be affixed to a tank or the like comprising a base member having an aperture formed therethrough, means on said base member for attaching the same to a dispenser tank, a skirt portion extending from one side of said base member and surrounding said aperture, gripper means formed on the wall of said aperture, a yieldable container member rotatably mounted within said skirt and including a closed end portion extending therebeyond, said container member having at its other end a closeable spout assembly including an elongate, resiliently deformable spout having an internal thread portion, a complemental thread portion formed on said container in threaded engagement with said spout, a valve member interposed between said spout and said container, said valve member being shifted to a sealed position responsive to relative rotation of said spout and container in a first direction and being shifted to an open position responsive to relative rotation of said spout and container in an opposite direction, said spout and container being free wheeling in said open position when relatively rotated in said opposite direction and locked against relative rotation in said sealed position when rotated in said first direction, said spout including an external surface portion force fittingly engaged within said aperture whereby said spout may be rotated relative to said container responsive to forces exerted against said container, said spout being readily removable in an axial direction from said force fitted engagement responsive to combined radial and axial removing forces exerted on said spout and being resistant to axial displacement from said force fitted engagement responsive to axial forces only exerted against said spout, whereby said container can conveniently be removed from said base member only when said valve is in the sealed position.

2. A safety dispenser in accordance with claim 1, wherein said spout is generally frusto-conical in configuration, with the wider base of said spout being closer to said container than the narrow base, and said gripper means comprises radially directed serrations.

3. A dispenser in accordance with claim 2, wherein said serrations comprise axially directed indentations formed in the walls defining said aperture.

4. A safety dispenser in accordance with claim 2, wherein said spout includes on its peripheral surface a plurality of axially directed rib members.

5. A safety dispenser in accordance with claim 1, wherein said skirt includes a cage member surrounding portions of said container disposed beyond said skirt, said cage including opposed access opening means for enclosing said container to be compressed to discharge the contents thereof.

6. A dispenser in accordance with claim 1, wherein said valve member comprises a stem extending outwardly from said container and said spout includes a valve seat shiftable toward and away from said stem responsive to relative rotation of said container and said spout in said first and said opposite directions respectively.

7. A safety dispenser for corrosive and like liquid materials packaged in a deformable plastic container having a valve closure assembly which includes an elongate, resilient, deformable dispenser spout having a dispenser passage including a valve seat at one end and an internal thread at the other end, the exterior surface of said spout being of increasing diameter at portions progressively nearer said container, said container including a complemental external threaded portion engaging said thread of said spout and a valve member disposed in said passage, said valve member being shiftable between a sealing position against said seat and an open position clear of said seat responsive to relative rotation of said spout and said container, respectively, in an opening and closing direction, said container and spout being free wheeling relative to said container at said open position when relatively rotated in said opening direction and in locked engagement with said container when rotated in said closing direction at said sealed position, said dispenser comprising a base portion, means on said base portion for attachment to a receiver tank or the like, an aperture formed through said base portion, the walls defining said aperture including serrations, said aperture being sized to provide a force fit connection with said exterior surface of said spout responsive to axial movement of said spout into said aperture, a partially open cage structure extending from said base, said cage structure being sized to receive and rotatably support a container mounted therein while providing manual access to portions of said container, said container being demountable from said dispenser responsive to axial outward forces exerted thereon while said spout is caused to rotate relative to said aperture, said spout being resistant to removal responsive to forces exerted in an axial direction only, whereby said container can be conveniently removed from said base member only when said valve is in said sealing position.

* * * * *